United States Patent [19]

Lundstrom et al.

[11] 4,152,987

[45] May 8, 1979

[54] IMPERMEABLE POLYMER BOMB LINER FOR USE WITH TNT CONTAINING EXPLOSIVES

[75] Inventors: Norman H. Lundstrom, Auburn, Wash.; Russell Reed, Jr., Ridgecrest, Calif.

[73] Assignee: The United States of America as represented by the Secretary of the Navy, Washington, D.C.

[21] Appl. No.: 770,247

[22] Filed: Feb. 18, 1977

[51] Int. Cl.[2] ..... F42B 25/14

[52] U.S. Cl. ..... 102/6; 102/65; 102/90

[58] Field of Search ..... 102/2, 6, 90, 56 R, 102/66, 65, 64, 67; 86/20, 17, 1 R

[56] References Cited

U.S. PATENT DOCUMENTS

| | | | |
|---|---|---|---|
| 2,373,883 | 4/1945 | Ferrel | 102/56 |
| 2,790,389 | 4/1957 | Ackerman | 102/90 X |
| 3,031,294 | 1/1967 | Bryant et al. | 264/3 |
| 3,311,013 | 3/1967 | Phipps | 86/20 R |
| 3,485,171 | 12/1969 | Wessells | 102/66 X |
| 3,570,401 | 3/1971 | Euker | 102/66 X |
| 3,693,548 | 9/1972 | Dereich et al. | 102/2 |
| 3,730,093 | 5/1973 | Cummings | 102/66 X |
| 3,774,022 | 11/1973 | Dubrow et al. | 102/65 X |
| 3,830,671 | 8/1974 | McArdle | 102/90 X |
| 3,893,814 | 7/1975 | McGhee | 102/66 X |
| 4,044,684 | 8/1977 | Gaggini et al. | 102/90 |

OTHER PUBLICATIONS

"The Condensed Chemical Dictionary", Van Nostrand Reinhold Co. (1971), pp. 699, 715, 774, 245.

*Primary Examiner*—David H. Brown
*Attorney, Agent, or Firm*—R. S. Sciascia; W. Thom Skeer

[57] ABSTRACT

A polymeric bomb liner prepared from a polyvinylidene chloride latex emulsion.

10 Claims, 1 Drawing Figure

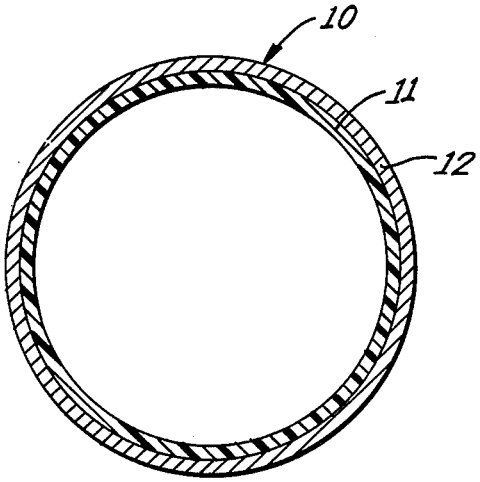
10
11
12

IMPERMEABLE POLYMER BOMB LINER FOR USE WITH TNT CONTAINING EXPLOSIVES

BACKGROUND OF THE INVENTION

1. Field of the Invention

This invention relates to bomb liners.

2. Description of the Prior Art

Bomb liners have, in the past, generally been fabricated from asphalt. Asphalt, while it is inexpensive and easy to apply as a liner, has certain drawbacks. One of these drawbacks is the fact that it is not impervious to an explosive such as trinitrotoluene (TNT). Another is that it is exothermically reactive with hot TNT. The result of these drawbacks may be readily imagined if one considers what happens if an asphalt lined bomb casing is (1) loaded with TNT and (2) accidently exposed to a fire or even fairly intense heat. When the molten TNT is poured into the bomb it permeates the asphalt liner and becomes intimately mixed with it. Then, when the TNT is heated by the fire, it and the asphalt react giving off still more heat. A violent explosion is often the result.

Another drawback of asphalt liners lies in the fact that they tend to harden and crack when subjected to thermal cycling. When this happens, the explosive within the bomb exudes through the cracks and comes into contact with metal casing of the bomb—something the liner was put in to prevent. Because of these drawbacks, substitutes for asphalt have been considered.

BRIEF DESCRIPTION OF THE DRAWINGS

The single FIGURE is a cross-sectional view of a bomb with a polyvinylidene chloride liner according to this invention installed.

SUMMARY OF THE INVENTION

The single FIGURE of the drawing depicts, in cross-section, a bomb 10 which has a polyvinylidene chloride liner 11 attached to a metal casing 12.

According to this invention, polyvinylidene chloride is used to line a hollow bomb casing. Polyvinylidene chloride overcomes the drawbacks associated with asphalt. It is both impervious to TNT and unreactive with TNT. Additionally, it is an elastomer which does not tend to harden and crack when subjected to thermal cycling.

Polyvinylidene chloride may be readily applied to the inner surface of a bomb casing from a latex emulsion and has the advantage of being inexpensive.

DESCRIPTION OF THE PREFERRED EMBODIMENTS

Latex emulsions of polyvinylidene chloride are well known and may be commercially obtained. They are generally comprised of a plurality of polyvinylidene chloride particles suspended as discrete entities in water. The emulsion generally contains approximately 50% by weight polyvinylidene chloride and a balance of water.

To deposit or lay down a polyvinylidene chloride liner in a hollow bomb casing, one simply pours the emulsion into the casing and spins the casing while the water evaporates. As the water evaporates, the polyvinylidene chloride particles adhere to the inner surface of the casing and to each other, and thereby form a smooth coating on the inner surface.

The thickness of a polyvinylidene chloride bomb liner is not critical. Liners as thin as 0.05 inch are suitable and thicker liners have no deleterious effects unless one considers additional thickness detrimental because it slightly reduces the amount of explosive that can subsequently be loaded into the bomb.

Polyvinylidene chloride is completely impervious to TNT even when TNT is heated to its melting point and poured into a lined bomb basing in the usual manner. It is also completely unreactive with TNT.

Tests have indicated that thermal cycles much more severe than those to which a bomb would ordinarily be exposed do not cause a polyvinylidene chloride liner to harden and crack.

If it is desired, a thickener such as aerosil (submicron silica) may be added to the polyvinylidene chloride latex emulsion prior to application. This has the effect of speeding up the deposition of the liner.

Also, materials which will produce case rupturing gases in the event that the bomb is subjected to fire may be added to the emulsion and used to form part of the liner.

One may also form an incendiary bomb liner by introducing encapsulated magnesium, aluminum, zirconium, hafnium or other incendiary metal powders into the emulsion prior to application. Encapsulation prevents hydrogen formation due to chemical reaction of the metal with the emulsion during application.

The problems attendant when TNT is loaded into an asphalt lined bomb casing have been spoken of above. However, it is not contemplated that this invention be confined to liners for TNT loaded bombs. Plastic bonded explosives may be loaded into polyvinylidene chloride lined warhead casings in the usual manner (as a mix in which the binder is uncured) and the binder will wet the polyvinylidene chloride and stick to it when it cures.

What is claimed is:

1. As an article of manufacture, a bomb casing having an inner surface to which is directly attached a smooth coating of polyvinylidene chloride, said coating being impervious to trinitrotoluene.

2. A bomb comprising a hollow bomb casing having an inner surface, a smooth layer of polyvinylidene chloride directly attached to said inner surface and an explosive substantially filling the interior of said bomb inside of said layer of polyvinylidene chloride, said layer of polyvinylidene chloride being impervious to said explosive.

3. A bomb according to claim 2 wherein said explosive is a plastic bonded explosive.

4. A bomb according to claim 2 wherein said layer of polyvinylidene chloride has a thickness of about 0.05 inch.

5. A bomb according to claim 2 wherein said explosive is trinitrotoluene.

6. A bomb according to claim 5 wherein said layer of polyvinylidene chloride has a thickness of about 0.05 inch.

7. A bomb comprising a hollow bomb casing having an inner surface, a smooth layer of polyvinylidene chloride directly attached to said inner surface and an explosive substantially filling the interior of said bond inside of said layer of polyvinylidene chloride, said layer of polyvinylidene chloride being impervious to said explosive and said layer of polyvinylidene chloride containing incendiary metal powder.

8. A bomb according to claim 1 wherein said metal powder is selected from the group consisting of magnesium, aluminum, zirconium and hafnium.

9. A bomb according to claim 7 wherein said layer of polyvinylidene chloride has a thickness of about 0.05 inch.

10. A bomb according to claim 9 wherein said powder is selected from the group consisting of magnesium, aluminum, zirconium and hafnium.

* * * * *